US011008079B1

(12) United States Patent
Davis

(10) Patent No.: US 11,008,079 B1
(45) Date of Patent: May 18, 2021

(54) DEVICES, SYSTEMS, AND METHODS FOR ALIGNING A BOAT SKELETON TO FORM A BOAT HULL

(71) Applicant: Scott Alan Davis, Evergreen, CO (US)

(72) Inventor: Scott Alan Davis, Evergreen, CO (US)

( * ) Notice: Subject to any disclaimer, the term of this patent is extended or adjusted under 35 U.S.C. 154(b) by 0 days.

(21) Appl. No.: 16/554,863

(22) Filed: Aug. 29, 2019

(51) Int. Cl.
*B63B 3/26* (2006.01)
*B63B 73/00* (2020.01)
*B63C 5/02* (2006.01)

(52) U.S. Cl.
CPC ..... *B63C 5/02* (2013.01); *B63B 3/26* (2013.01); *B63B 73/00* (2020.01); *B63C 2005/025* (2013.01)

(58) Field of Classification Search
CPC ..... B63C 5/02; B63C 2005/025; B63B 9/06; B63B 3/26; B63B 3/02; Y10T 29/49826; Y10T 29/49883; Y10T 29/49892; Y10T 29/4981
See application file for complete search history.

(56) References Cited

U.S. PATENT DOCUMENTS 833,511 A * 10/1906 Dean ..... A63H 27/001 446/88
3,793,768 A * 2/1974 Surving ..... A63H 23/005 446/86
4,044,414 A * 8/1977 Grycel, III ..... B63B 9/06 114/355
4,568,299 A * 2/1986 Montgomery ..... A63H 23/00 114/358
6,378,707 B1 * 4/2002 Taggert ..... A47B 65/00 211/186
7,758,405 B2 7/2010 Bunce
9,597,781 B2 3/2017 Ozu et al.
(Continued)

FOREIGN PATENT DOCUMENTS

WO WO-0218200 A1 * 3/2002

OTHER PUBLICATIONS

ModelShipBuilder Forum: http://www.modelshipbuilder.com/e107_plugins/forum/forum_viewtopic.php?21953.10, uploaded by ToddM on Apr. 30, 2015, (retrieved by examiner on Jan. 3, 2020) (Year: 2015).*

(Continued)

*Primary Examiner* — Anthony D Wiest
(74) *Attorney, Agent, or Firm* — Red Rocks Law, LLC

(57) ABSTRACT

Disclosed herein is an alignment system which is tractable by amateur boat builders and flat-packable for shipping, to assist such builders in assembling plate-based boat hulls free from hull skin warping, such system comprised of (a) longitudinal and transverse skeleton elements, such elements employing half-lap or similar joints and (b) an alignment jig comprised of a horizontal plate with intruded deep slots corresponding to the thickness and location of upper edges of the skeleton elements. The jig is set atop a planar surface (i.e., concrete floor or worktable), with the slots facing upwards. The skeleton elements are inverted, mated with each other at the half-lap joints, and inserted into the slots in the plate jig. The slots and the skeleton joints work together to maintain precise location and rotation of all skeleton elements, such that the edges of the freestanding skeleton present a developable arc for hull skin panel installation.

18 Claims, 17 Drawing Sheets

(56) References Cited

U.S. PATENT DOCUMENTS

| | | | |
|---|---|---|---|
| 10,010,985 | B2 | 7/2018 | Akahane et al. |
| 10,297,488 | B2 | 5/2019 | Fukuoka |

OTHER PUBLICATIONS

Woodworkers Journal, "Router Joinery Basics: Dado", uploaded to YouTube Dec. 27, 2011 https://www.youtube.com/watch7v=3ZnGETOFgcg (retrieved by examiner on Jan. 2, 2020) (Year: 2011).*

* cited by examiner

DEVICES, SYSTEMS, AND METHODS FOR ALIGNING A BOAT SKELETON TO FORM A BOAT HULL

TECHNICAL FIELD

This disclosure relates to flat-packable boat kits that may be shipped to amateur boat builders, who assemble the resulting boats without the aid of factory tooling.

BACKGROUND

Typically, a boat hull 50 is an integration of three primary structural systems as shown in FIG. 1: a skeleton 52 composed of both longitudinal and transverse elements, a hull skin 54 composed of panels wrapped around the skeleton 52, and optionally a deck 56 composed of panels both attached to the top of the skeleton 52 and terminating at the top of the hull skin panels 54.

The boat building field is composed of various designs, manufacturing methods, and materials used for these three structural systems. Some boats can be made from wood plate materials such as plywood, which can create challenges since the hull skin is curved, whereas the hull skin plates (from which the skin is formed) are flat. While flat hull skin plates can be bent smoothly into curves, these curves must be perfectly conical or cylindrical. Such curves are called developable, because they can be constructed from plates. Bending a hull skin plate around any non-developable arc will result in warping, which is an aesthetic and performance flaw in a hull.

A boat's hull skin plates 54 are attached to the outer edges of the skeleton elements 52, such that the arc that the hull skin plates will form is defined by the outer edges of skeleton elements. Consequently, designers specify precisely the shape and size to which these elements will be manufactured, as well as the positioning of these elements relative to one another, such that the resulting outer edges of all the skeleton's elements 52 will together correspond to the desired hull curve over which the hull skin plates 54 will be bent. Therefore, precision manufacturing of parts is necessary but not sufficient; the position and orientation of the skeleton elements 52 during assembly are also subject to tight precision tolerances to prevent any departure from a developable arc in the hull skin panels 54.

Experienced artisans and production factories have evolved sophisticated methods and tooling to ensure the skeleton elements 52 are located precisely so that the attached hull skin panels 54 form the desired hull curve. Typically, these methods revolve around the construction of a freestanding jig 60 (FIG. 2) which seeks to hold the skeleton elements 52 in perfect alignment such that hull skin panels 54 can be attached in a developable arc.

These conventional jigs 60 employ columns or plates 62 that extend vertically/upwardly at defined horizontal stations from a planar base; a simplified version of a conventional jig 60 is illustrated in FIG. 2. Skeleton elements 52 are then attached to the vertical elements 62 of the jig 60, as shown in FIG. 3, typically using screws. These attachments must be done such that the skeleton elements 52 are held precisely relative to each other—both with respect to position along each axis and with respect to rotation around each axis.

Building a precision freestanding conventional jig structure 60 (such as shown in FIGS. 2-3) that is axially and radially true in three dimensions requires specialized expertise and tools, both of which are the domain of artisans and production factories but not amateurs. Further, building such a conventional jig 60 involves a significant investment of time in addition to and relative to the time required to build the boat hull on the jig thereafter.

Further, when a hull is formed and completed on such a conventional jig 60, a worker must crawl under the hull to unscrew the skeleton 52 from the jig 60 before the hull can be lifted off for finishing work.

Moreover, to the extent that an amateur boat builder attempts to build a freestanding conventional jig 60 such as shown in FIG. 2-3, the resulting jig 60 can have various imprecise portions, and it is believed that there is generally no effective method or apparatus tractable by the amateur to ensure precise alignment of the skeleton 52 to the jig 60 prior to hull panel 54 attachment. The resulting hull 50 can therefore be formed with various deformations that adversely affects the overall performance of the boat's hull 50 when traveling in water.

SUMMARY

Disclosed herein is an alignment system which is tractable by amateur boat builders and flat-packable for shipping, to assist such builders in assembling plate-based boat hulls free from hull skin warping, such system comprised of (a) longitudinal and transverse skeleton elements, such elements employing half-lap or similar joints and (b) an alignment jig comprised of a horizontal plate with intruded deep slots corresponding to the thickness and location of upper edges of the skeleton elements. The jig is set atop a planar surface (i.e., concrete floor or worktable), with the slots facing upwards. The skeleton elements are inverted, mated with each other at the half-lap joints, and inserted into the slots in the plate jig. The slots and the skeleton joints work together to maintain precise location and rotation of all skeleton elements, such that the edges of the freestanding skeleton present a developable arc for hull skin panel installation.

According to another broad aspect of another embodiment of the present disclosure, a boat hull system is disclosed which may include (a) longitudinal and transverse skeleton elements, such elements employing half-lap or similar joints, and such elements all terminating on a common upper plane, and (b) an alignment jig (also referred to herein as a plate jig) defined by a horizontal plate into which has been intruded deep slots terminating at a common lower plane, the thickness of such slots corresponding to the thickness of the skeleton elements, and the location of such slots in the XY plane corresponding to the edges where the longitudinal and transverse skeleton elements terminate at their common upper plane.

In one example to form a boat hull, the plate jig may be set atop worktable, concrete floor or other planar surface. The elements of the skeleton are inverted and inserted completely into the slots in the plate jig. The slots and the skeleton joints fit and work together to maintain precise location and rotation in the skeleton, such that the edges of the freestanding skeleton present a developable arc for hull panel installation and attachment to the skeleton.

In this manner, embodiments of the present disclosure enable a manufacturer to produce a set of planar parts for a boat hull, so that the manufacturer flat-packs all of those parts into a shipping pallet and ships the pallet to an amateur builder, who then assembles the boat hull. Through the use of embodiments of the present disclosure, an amateur boat builder can achieve precise alignment of the skeleton prior to the hull panels being attached to the skeleton. The amateur builder can build a non-deformed boat hull without specialized factory tooling such as a factory jig, and the amateur builder uses relatively simple instructions and methods for building the boat.

According to another embodiment of the present disclosure, disclosed herein is a system for aligning a boat skeleton. In one example, the system may include at least one longitudinal spine member with at least one slot in a bottom edge; at least one transverse rib member, the rib member having a slot adapted to be inserted into the at least one slot of the spine member; and a jig including at least a first pair of opposing slots to receive a portion of the top surfaces of the spine member, the jig also including at least a second pair of opposing slots to receive a portion of the top surfaces of the rib member.

In one example, the depths of the first pair of opposing slots are equal to the depths of the second pair of opposing slots.

The jig may include a first end portion, a second end portion, and a central portion between the first and second end portions. The first pair of opposing slots may be positioned on a set of outer edges of the first end portion and the second end portion. The second pair of opposing slots may be positioned on a set of outer edges of the central portion of the jig.

In one example, the jig is a solid piece of wood material, such as but not limited to plywood, engineered wood material, MDF, or other material such as aluminum, metal, or rigid material.

The jig may be a single piece of material, or in another example the jig may be formed of a plurality of adjacently connected pieces of material, each piece having the same maximum thickness, wherein each piece of material has a connection interface for securely coupling with at least one other piece of the jig.

In another example, the jig may be formed of a plurality of stacked layers of material. The plurality of stacked layers of material may include a top layer and a bottom layer, wherein the first pair of slots are cut through the entire thickness of the top layer. The first pair of slots may be cut into the bottom layer wherein said first pair of slots have a depth less than the thickness of the bottom layer.

In another example, the first pair of opposing slots extends the length of the jig along the top surface of the jig. The second pair of opposing slots can extend across the width of the jig along the top surface of the jig.

In one example, the jig has an outer perimeter that is smaller than the perimeter defined by the inner edge of the hull skin.

In one example, the jig may be connected with the at least one rib member without the use of external fasteners. The jig may be connected with the at least one spine member without the use of external fasteners.

The jig may be formed by CNC milling of wood material or of other material.

According to another embodiment of the present disclosure, disclosed herein is a system for forming a boat hull skeleton. In one example, the system may include at least one longitudinal spine member with at least one slot in a bottom edge; at least one transverse rib member, the rib member having a slot adapted to be inserted into the at least one slot of the spine member; and a horizontal plate jig including at least a first pair of opposing slots to receive a portion of the top surfaces of the spine member, the jig also including at least a second pair of opposing slots to receive a portion of the top surfaces of the rib member.

According to another embodiment of the present disclosure, disclosed herein is a device for aligning a boat hull spine to at least one boat hull rib member. In one example, the device includes a planar wood material; at least a pair of opposing longitudinal slots defined in a top surface of the planar wood material, the opposing longitudinal slots configured to receive a portion of the top surfaces of the boat hull spine; and at least a pair of opposing transverse slots defined in the top surface of the planar wood material, the opposing transverse slots configured to receive a portion of the top surfaces of the boat hull rib member.

The features, utilities and advantages of various embodiments of the disclosure will be apparent from the following more particular description of embodiments of the disclosure as illustrated in the accompanying drawings.

DETAILED DESCRIPTION

Figure 1:
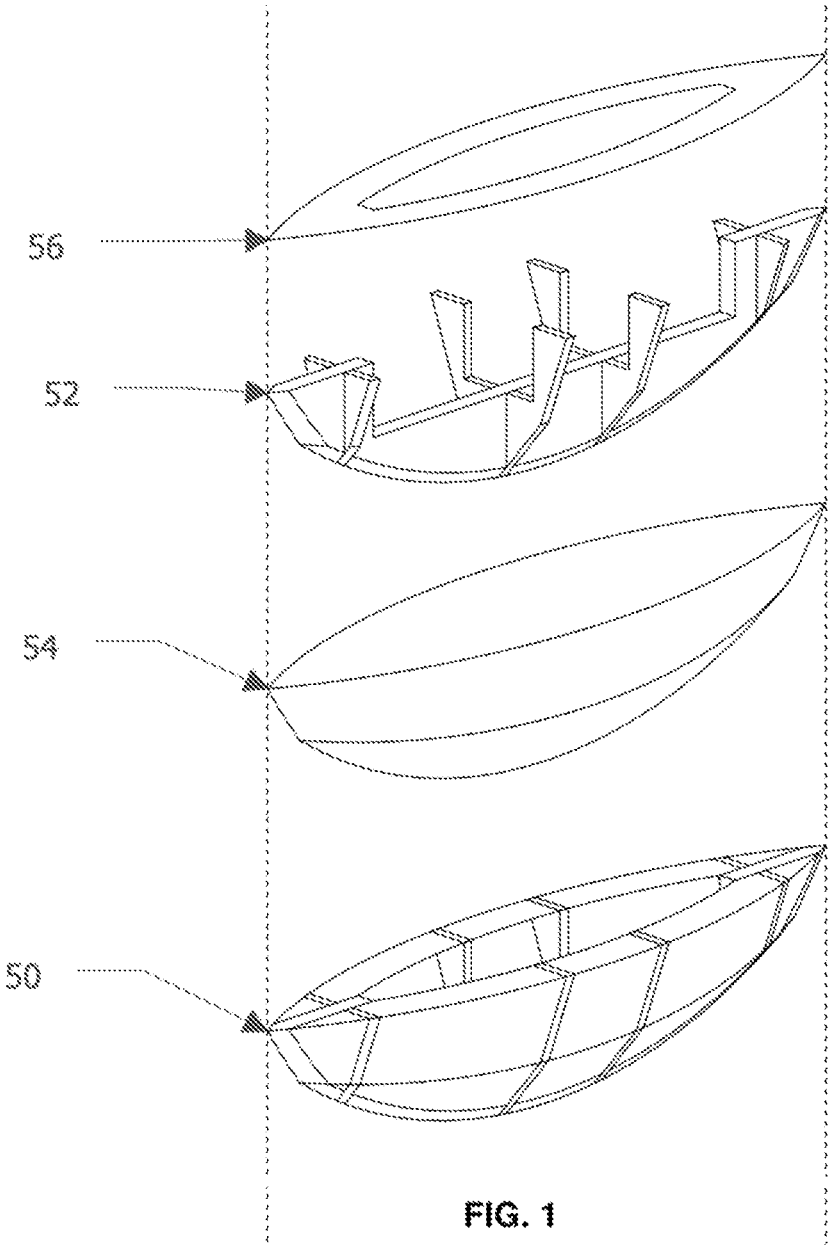
FIG. 1 illustrates an example of a boat hull, including a skeleton, hull skin panels, and a deck.
Figure 2:
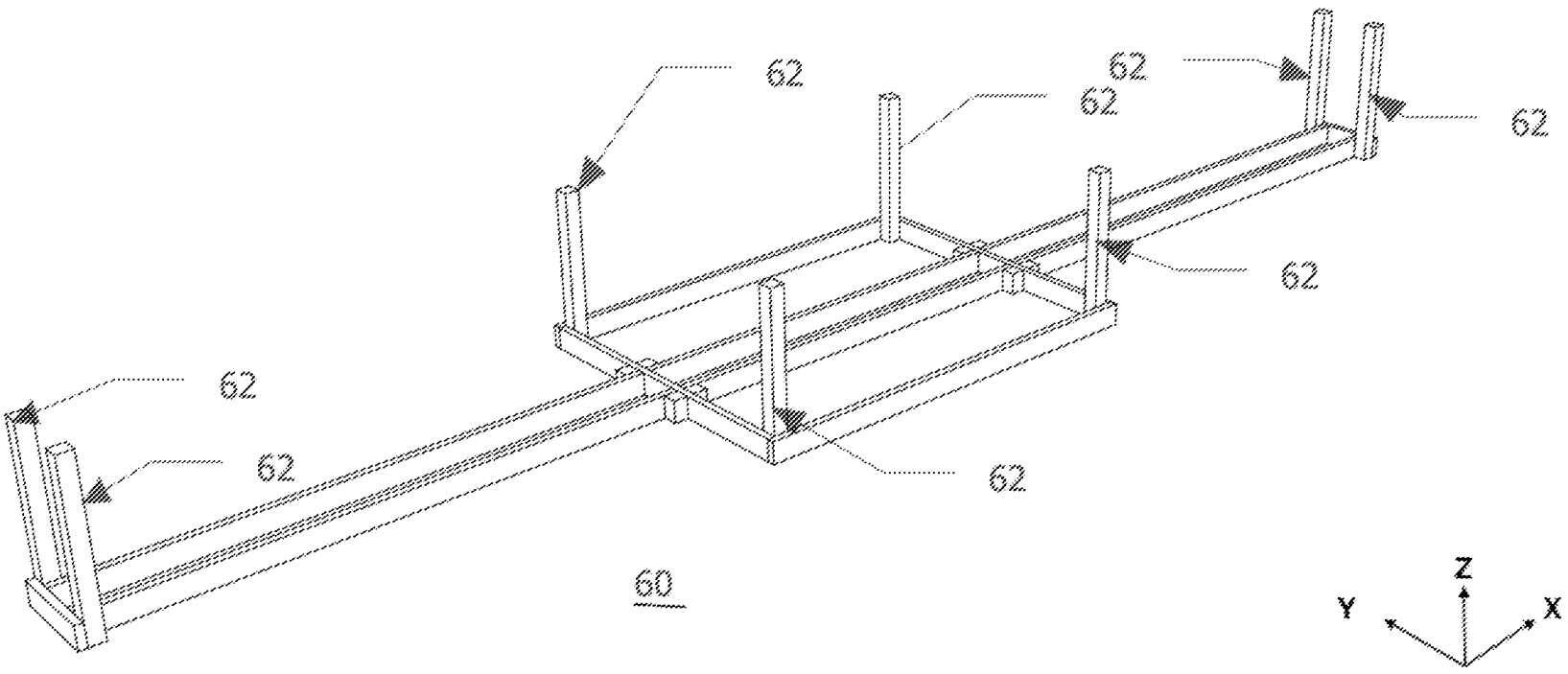
FIG. 2 illustrates a traditional boatbuilding jig for skeleton alignment.
Figure 3:
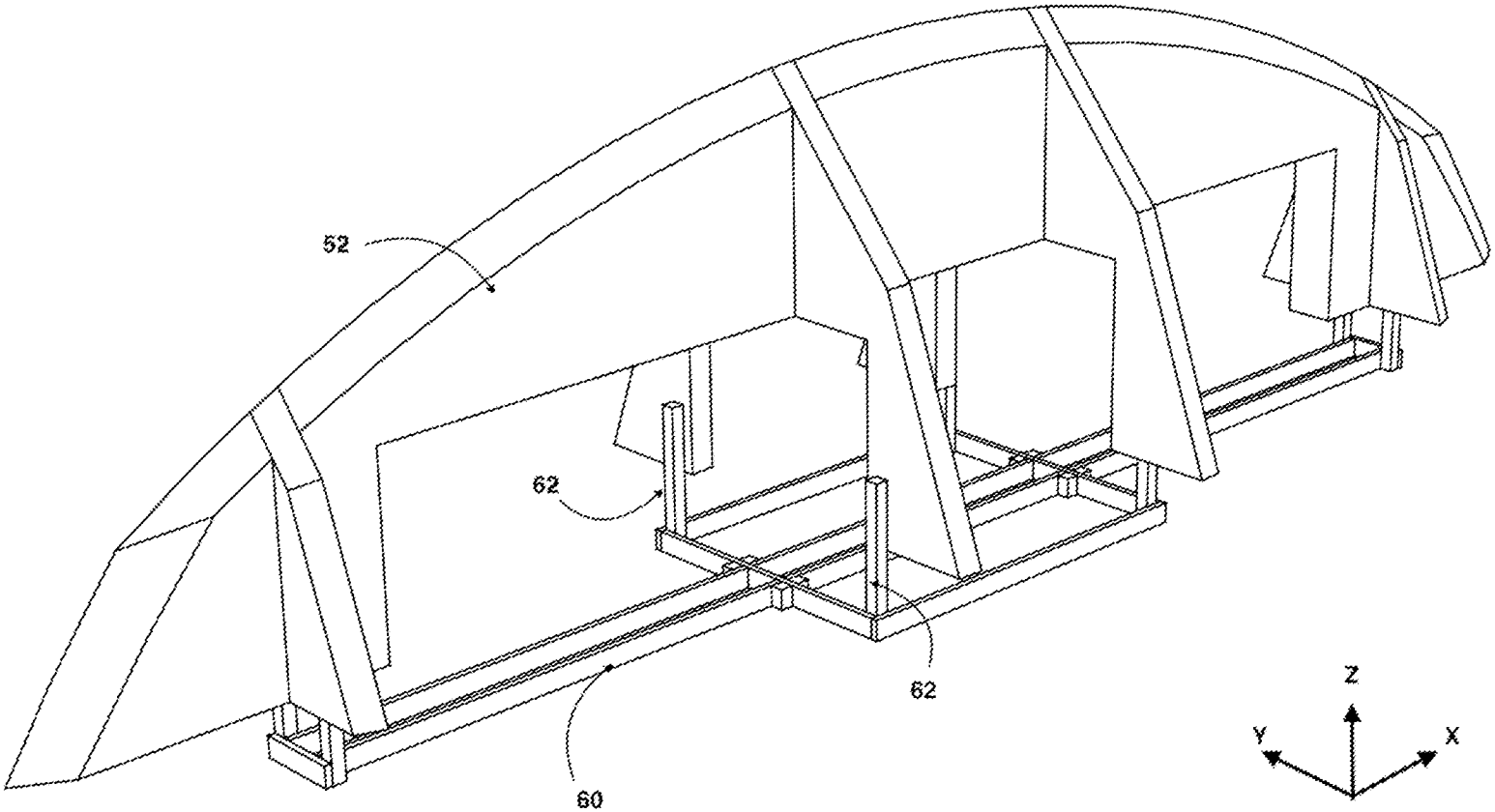
FIG. 3 illustrates a boat skeleton attached to traditional jig.

Various systems, devices and methods are disclosed herein in FIGS. 4-17 for aligning a boat skeleton or for forming a boat hull using an inventive alignment jig 90 with a spine 100 and ribs 106. In one example, a system may include at least one longitudinal spine member 100 with at least one slot 102 in a bottom edge 104; at least one transverse rib member 106, the rib member having a slot 108 adapted to be inserted into the at least one slot 102 of the spine member 100; and a plate jig 90 including at least a pair of opposing longitudinal slots 110 to receive a portion of the top surfaces of the spine member 100, the jig 90 also including at least a pair of opposing transverse slots 112 to receive a portion of the top surfaces of the rib member 106. In this manner, a boat skeleton 120 (FIG. 9) can be formed precisely and without the need of using fasteners to secure the boat skeleton 120 to the jig 90. The system enables amateur boat builders to build a high-quality boat skeleton and boat hull. Various embodiments of systems, devices and methods are disclosed herein.

Figure 16:
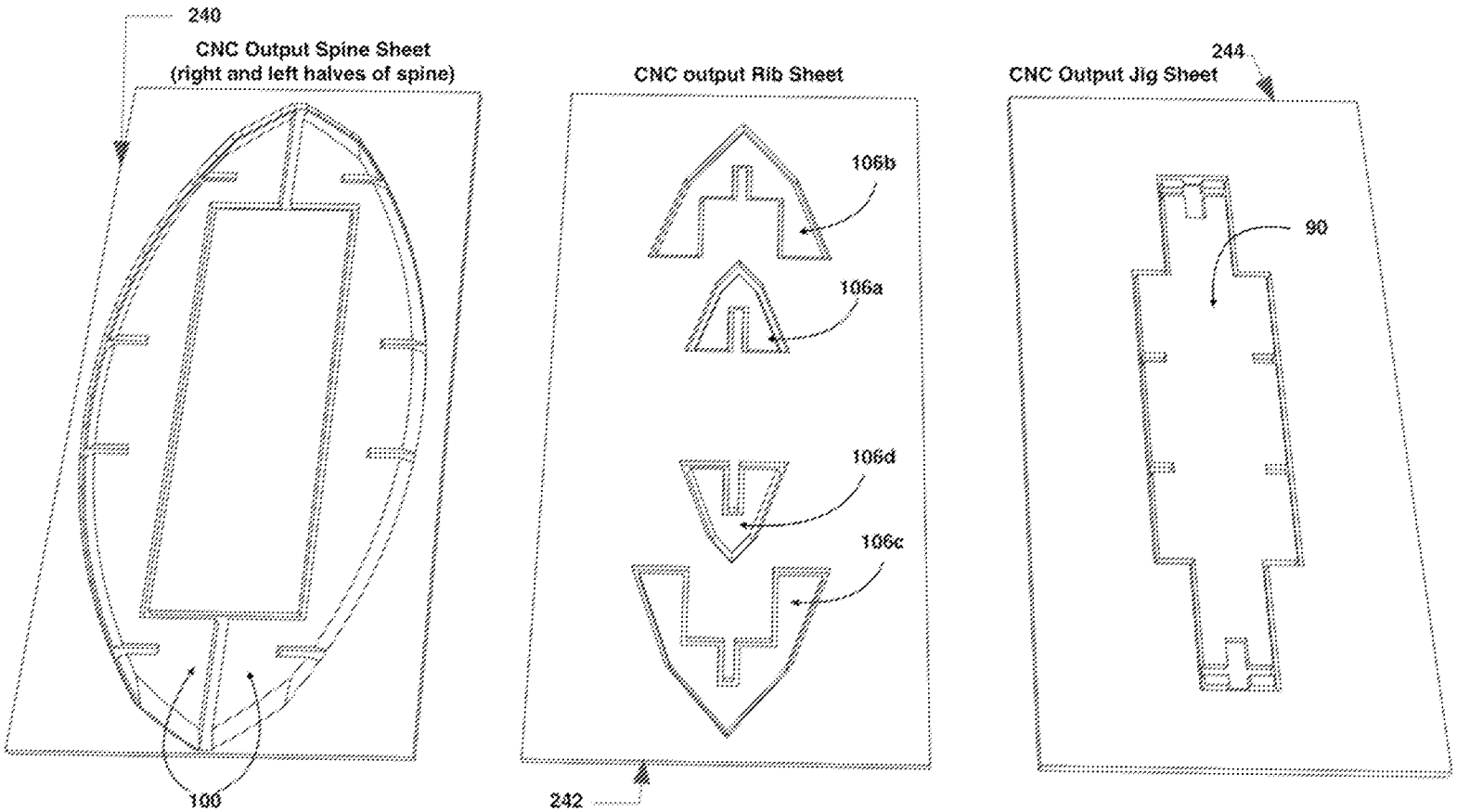
FIG. 16 illustrates examples of forming a spine, ribs, and a jig using CNC milling from a planar wood material, in accordance with one embodiment of the present disclosure.

In one example, the hull skeleton 120 may include at least one longitudinal element (such as a spine 100), at least one transverse element (such as one or more ribs 106), wherein each element 100, 106 may be fabricated from wood plate or wood-plate-composite material or other engineered wood material or other material suitable for a boat. Each rib 106 and spine 100 may be a single piece, or alternatively the spine 100 may be formed using two symmetrical half pieces (such as shown in the example of FIG. 16) connected together to form the spine 100. In one example, the spine 100 and the ribs 106 may use half-lap/overlapping joints at their intersections, where, during formation, material is removed from each piece to facilitate formation of a joint at a desired location. In one example, the spine 100 and ribs 106 terminate in a common plane at each joint, and the spine 100 and rib elements 106 terminate in that common plane orthogonally to that plane.

Figure 4A:
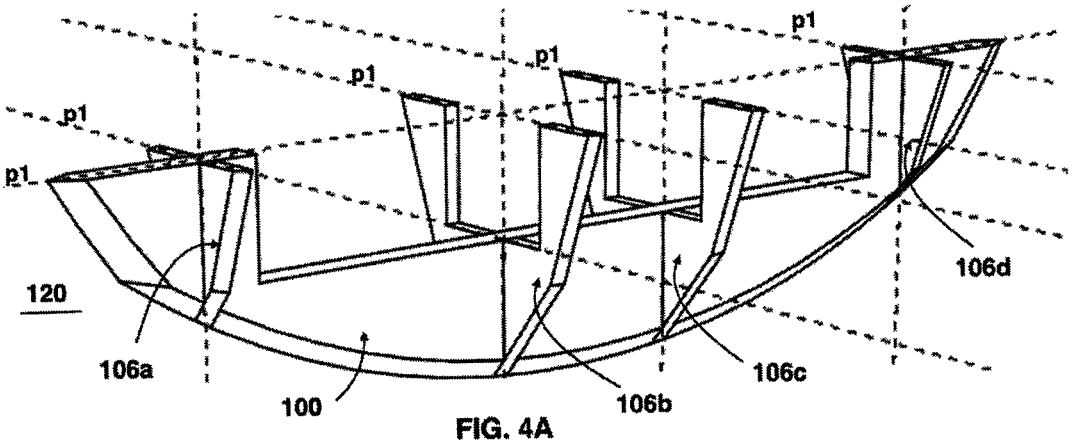
FIG. 4A illustrates an example of a complete half-lapped boat skeleton, including a spine and a plurality of ribs inserted in the spine, in accordance with one embodiment of the present disclosure.
Figure 4B:
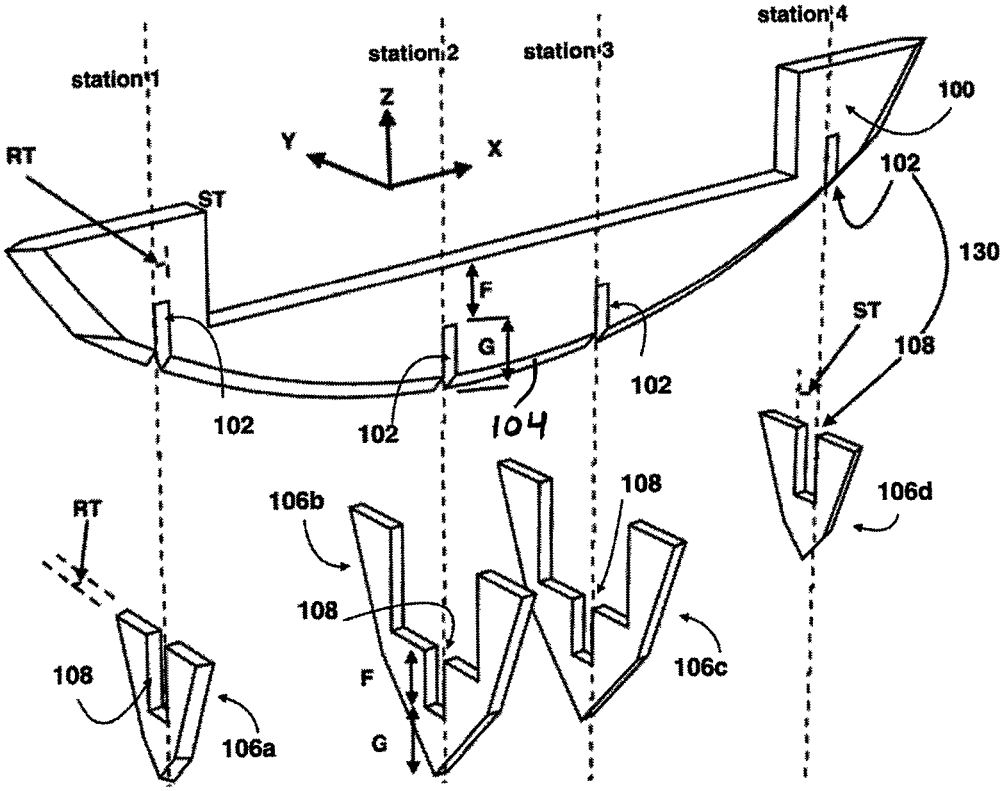
FIG. 4B illustrates an example of the components of a half-lapped boat skeleton, including a spine and a plurality of ribs, in accordance with one embodiment of the present disclosure.

FIGS. 4A-4B illustrate an example of a boat skeleton 120 which may be used in combination with a jig 90 of the present disclosure to form a boat hull. In the example of FIG. 4A, the boat skeleton 120 is formed using a longitudinal element such as a spine 100; and transverse elements such as ribs 106*a*, 106*b*, 106*c*, 106*d*; although it is understood that other combinations of the numbers and shapes of the spine 100 and ribs 106 may be used if desired depending upon the particular implementation.

In one example, ribs 106*a-d* are positioned along the spine 100 at stations 1, 2, 3 and 4 respectively. By way of example and with respect to rib 106*d* and spine 100 at station 4, FIG. 4B illustrates half-lap joint 130 wherein the slot 108 in the rib 106*d* is the same thickness as the spine thickness (shown as ST) plus a minimum tolerance amount to allow the rib slot 108 to slide over the spine 100 at station 4, and wherein the slot 102 in the spine is the same thickness as the rib thickness (shown as RT) plus a minimum tolerance amount to allow the rib 106*d* to slide into the spine slot 102 at station 4.

The other half-lap joints formed by the spine 100 and ribs 106*a-c* respectively at stations 1, 2, 3 can be made using rib slots in the same manner as slot 108 of rib 106*d*; and the corresponding other slots in the spine 100 at stations 1, 2, 3 can be formed in the same manner as spine slot 102 at station 4.

In one example, each rib 106*a-d* is a single part, unbroken at the spine intersection, and the spine 100 is a single part, unbroken by the rib intersections. In FIG. 4A, the points p1 around the tops of the skeleton elements 100, 106 reside on a common plane, and the skeletal plates 100, 106 intersect this common plane orthogonally.

When assembled together as shown in FIG. 4A, the top surfaces of spine 100 and ribs 106*a-d* reside on a horizontal plane shown as p1. Likewise, the depths of the corresponding slots 102, 108 in the spine 100 and in the ribs 106*a-d* are dimensioned such that when assembled, the bottom surfaces of spine 100 and ribs 106*a-d* are aligned along the bottom of the skeleton 120. For instance and by way of example, at station 2, the slot depth in rib 106*b* is shown as F, while the slot depth in the spine 100 at station 2 is shown as G, where G is also the terminal length of the rib 106*b* from the end of the rib slot to the bottom end/tip of rib 106*b*.

In one example, an alignment jig 90 may be formed from a plate or planar piece of wood or wood-composite material (such as MDF) or other engineered wood material or other rigid material such as metal, aluminum, etc. During use, jig 90, being planar, can be positioned on a planar substrate surface on which to rest, such as an elevated flat platform.

In one example, jig 90 has an outer perimeter that at all stations is less than or within the inner perimeter of the hull skin 140 (FIG. 10A) to be attached to the skeleton 120.

Figure 5:
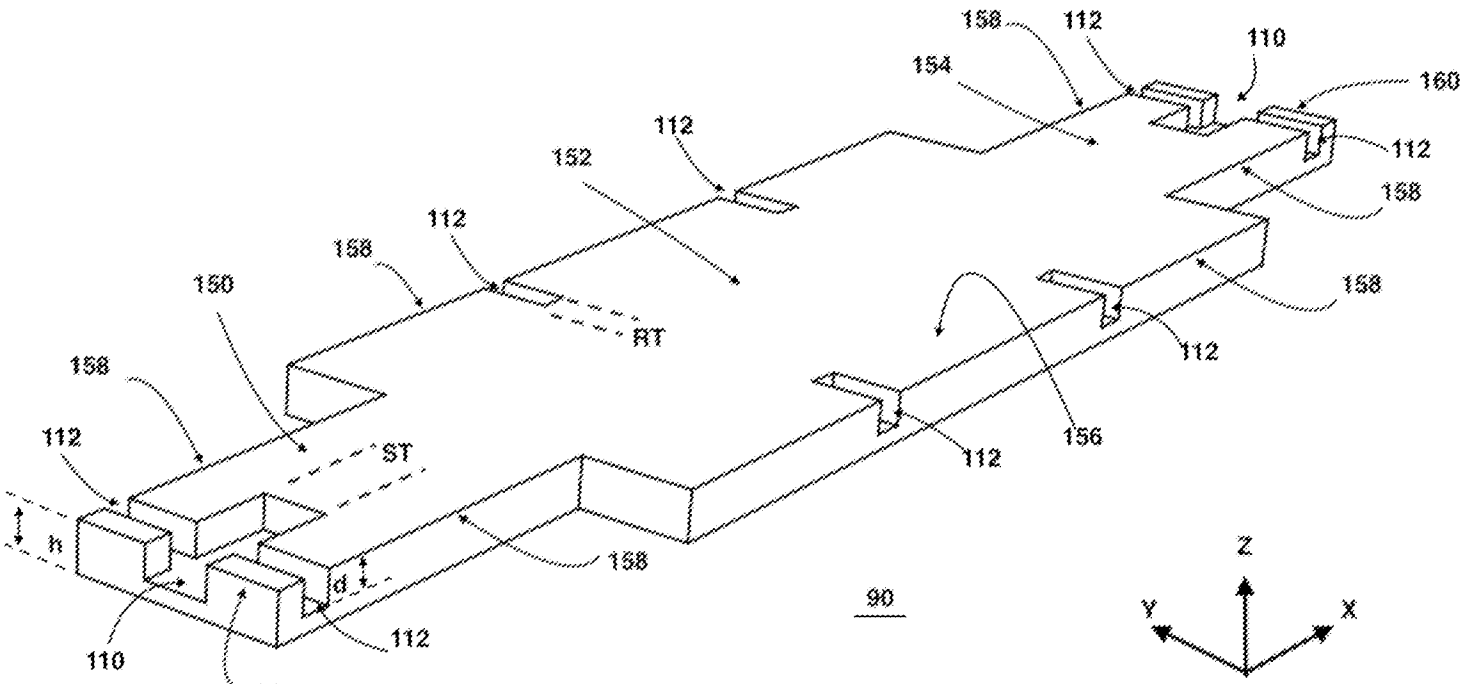
FIG. 5 illustrates an example of a horizontal plate jig for boat skeleton alignment, in accordance with one embodiment of the present disclosure.

FIG. 5 illustrates an example of a jig, which in this example is adapted to support the illustrative skeleton 120 shown in FIG. 4A. The jig 90 has slots 110, 112 defined or machined into its top surface, those slots 110, 112 being located to correspond the skeletal elements (for example, spine 100 and ribs 106*a-d*) intersections with their common plane at the locations of the slots. In one example, the slots 110, 112 have the same thickness as their corresponding skeletal elements plus a minimum tolerance amount to allow the elements 100, 106*a-d* to be inserted into the slots 110, 112, those slots 110, 112 being sufficiently deep to hold the skeletal elements 100, 106*a-d* erect without additional support, and the bottom surfaces of such slots 110, 112 in the jig 90 being coplanar with each other. In other words, in one example the slots 110, 112 in the jig 90 may all have the same depth.

As shown in FIG. 5, the jig 90 includes pairs of opposing transverse slots 112, each pair of opposing slots 112 adapted to receive the upper portions/top ends of a corresponding inverted rib 106. Slots 112 may be rectangularly shaped in one example, and may be positioned along the outer edges of the jig 90.

The jig 90 also includes at least one pair of opposing longitudinal slots 110, adapted to receive the upper portions/top ends of the spine 100 when inverted. Slots 110 may be rectangularly shaped in one example, and may be positioned along the outer edges of the jig 90.

The thickness of each slot 110, 112 corresponds to the thickness of the skeleton element located at that position; either RT (rib thickness) for slots 112, or ST (spine thickness) for slots 110, as shown in FIG. 5. In one example, the slots 110, 112 are all machined to the same and equal depth (d), where slot depth (d) is less than the thickness (h) of the jig plate 90. The depth (d) of the slots 110, 112 in the plate jig 90 ensures that the skeletal elements (spine 100 and ribs 106*a-d*) are held by the slot walls vertically orthogonal to the common lower plane in the bottom of the slots 110, 112. The slot depth (d) will vary depending upon the skeleton dimensions and material used in various implementations of the present disclosure.

In one example, the jig 90 includes a first end portion 150, a central portion 152, and a second end portion 154. The transverse slots 112 may be defined in and through the top surface 156 of jig 90 along an outer edge 158 of the first end portion 150, the central portion 152, and the second end portion 154 of the jig 90.

In one example, the longitudinal slots 110 may be defined in and through the top surface 156 along an outer edge 160 of the first end portion 150 and the second end portion 154 of the jig 90.

FIGS. 6-9 demonstrate how the slots in the jig, ribs, and spine force the parts to be assembled at the precise longitudinal and transverse offsets for a particular boat design.

Figure 6:
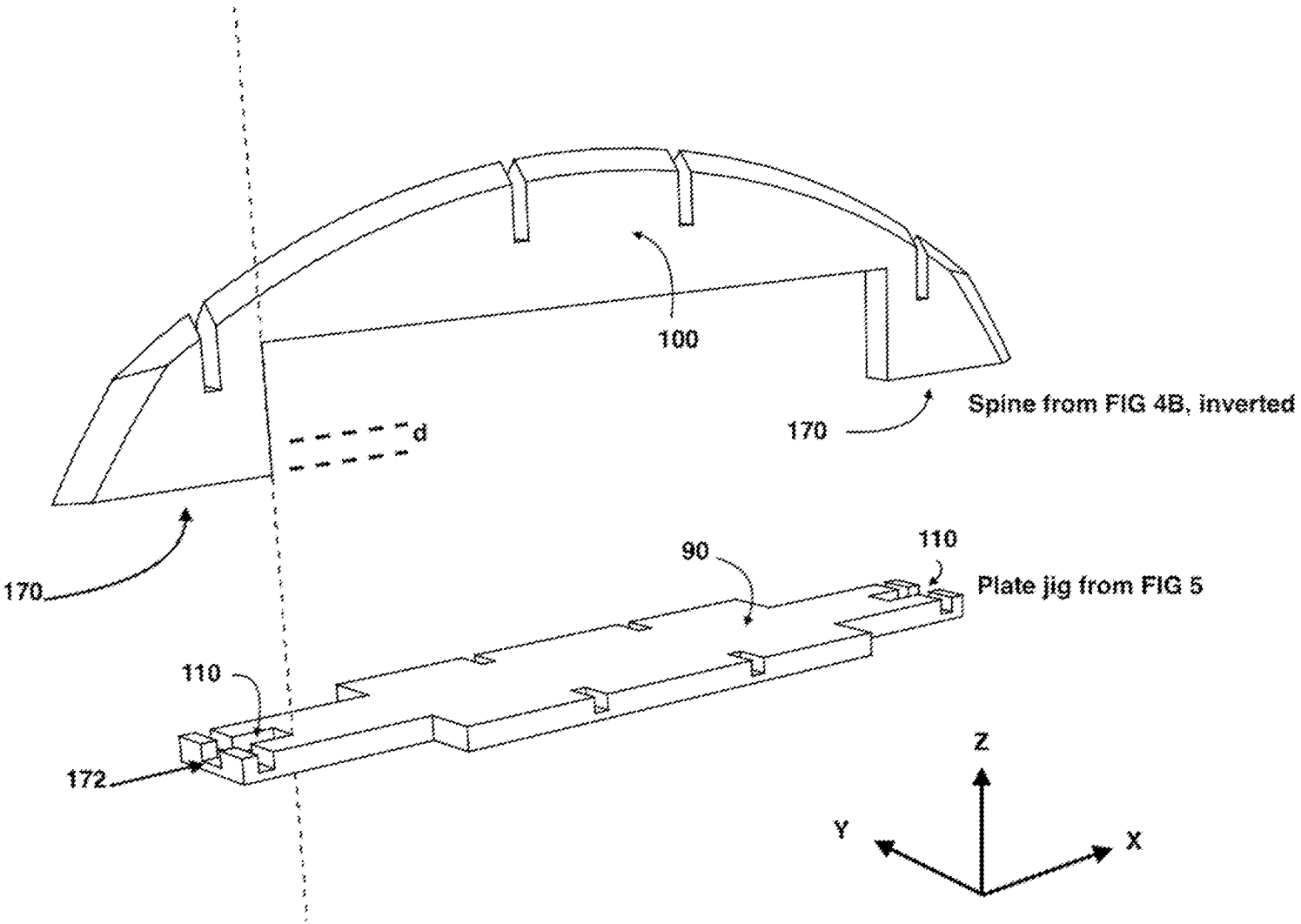
FIG. 6 illustrates a spine and a plate jig, wherein the spine is in an inverted position, in accordance with one embodiment of the present disclosure.
Figure 7:
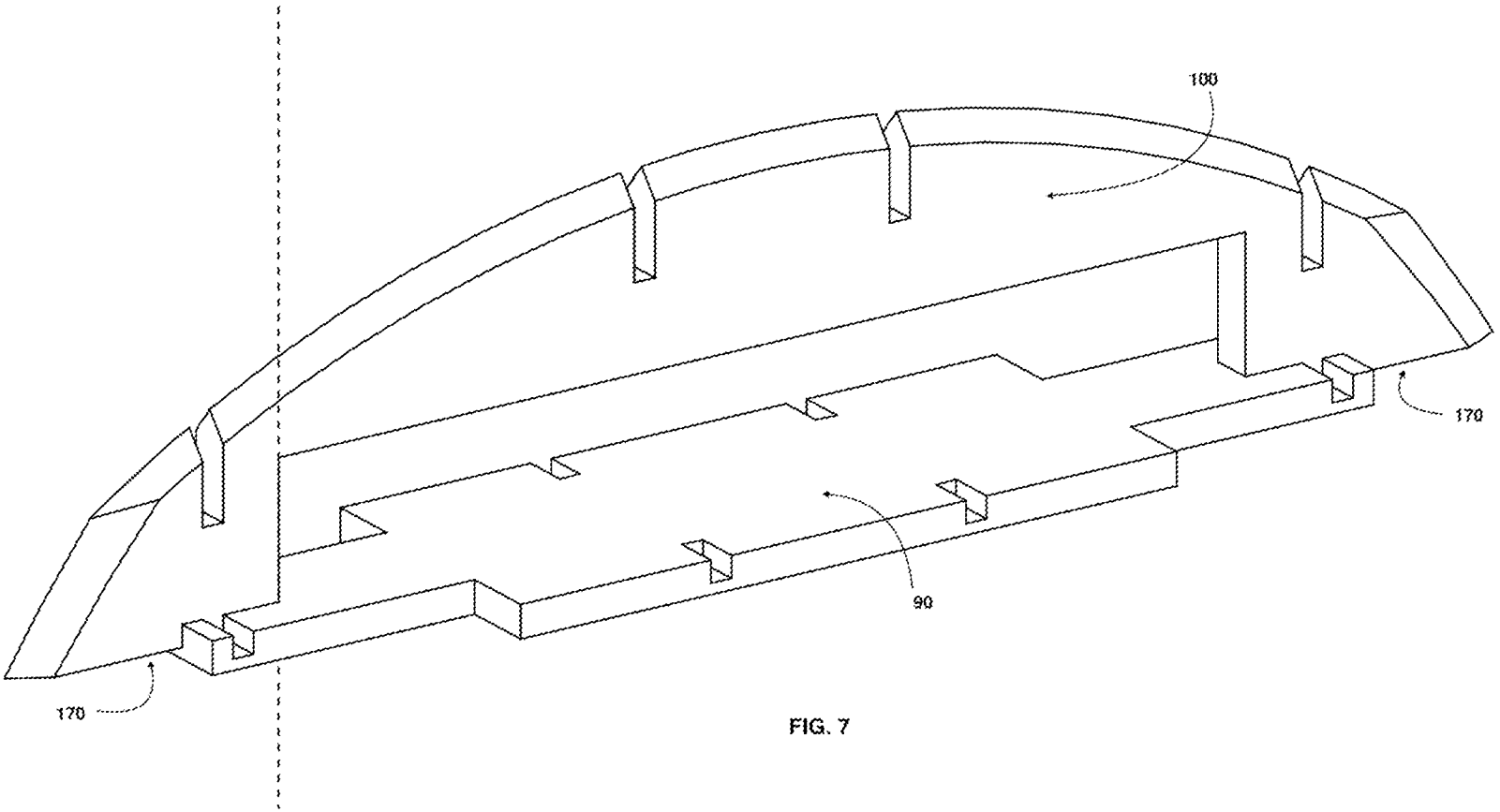
FIG. 7 illustrates the spine and plate jig of FIG. 6, wherein the spine is in an inverted position and the spine is inserted into the jig, in accordance with one embodiment of the present disclosure.

FIG. 6 shows the spine 100 from FIG. 4 inverted and aligned above the plate jig 90 from FIG. 5. In FIG. 7, the inverted spine 100 is inserted into the jig 90, where the spine 100 will stand on its own. Specifically, in FIGS. 6-7, a portion d of the planar top surface 170 of spine 100 is inserted into longitudinal slots 110 of the jig 90 until such surface 170 is fully seated on surface 172 in the bottom of slots 110 of jig 90.

Figure 8:
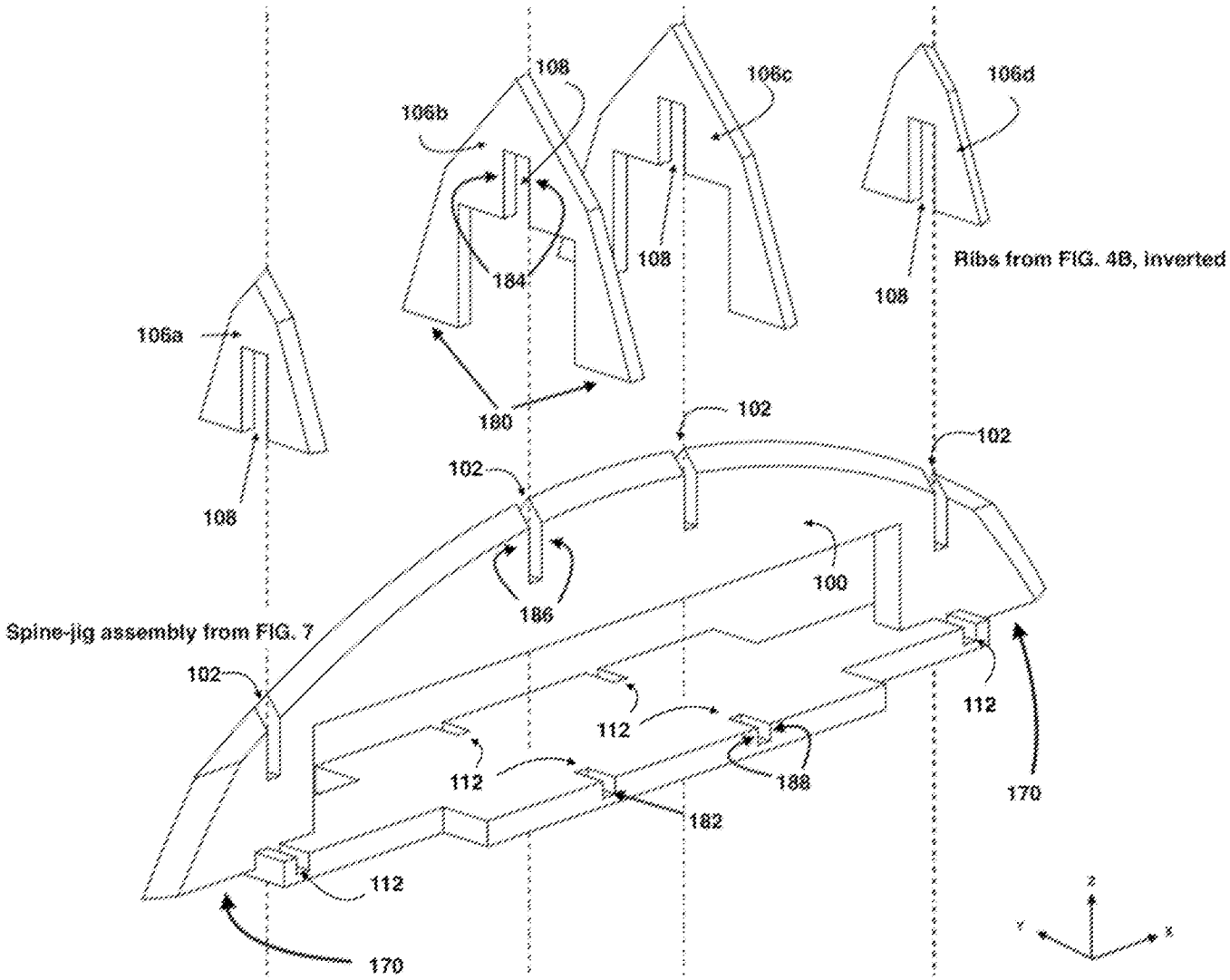
FIG. 8 illustrates a plurality of ribs and the spine and plate jig of FIG. 7, wherein the ribs are inverted and the spine is inverted and inserted into the jig, in accordance with one embodiment of the present disclosure.
Figure 9:
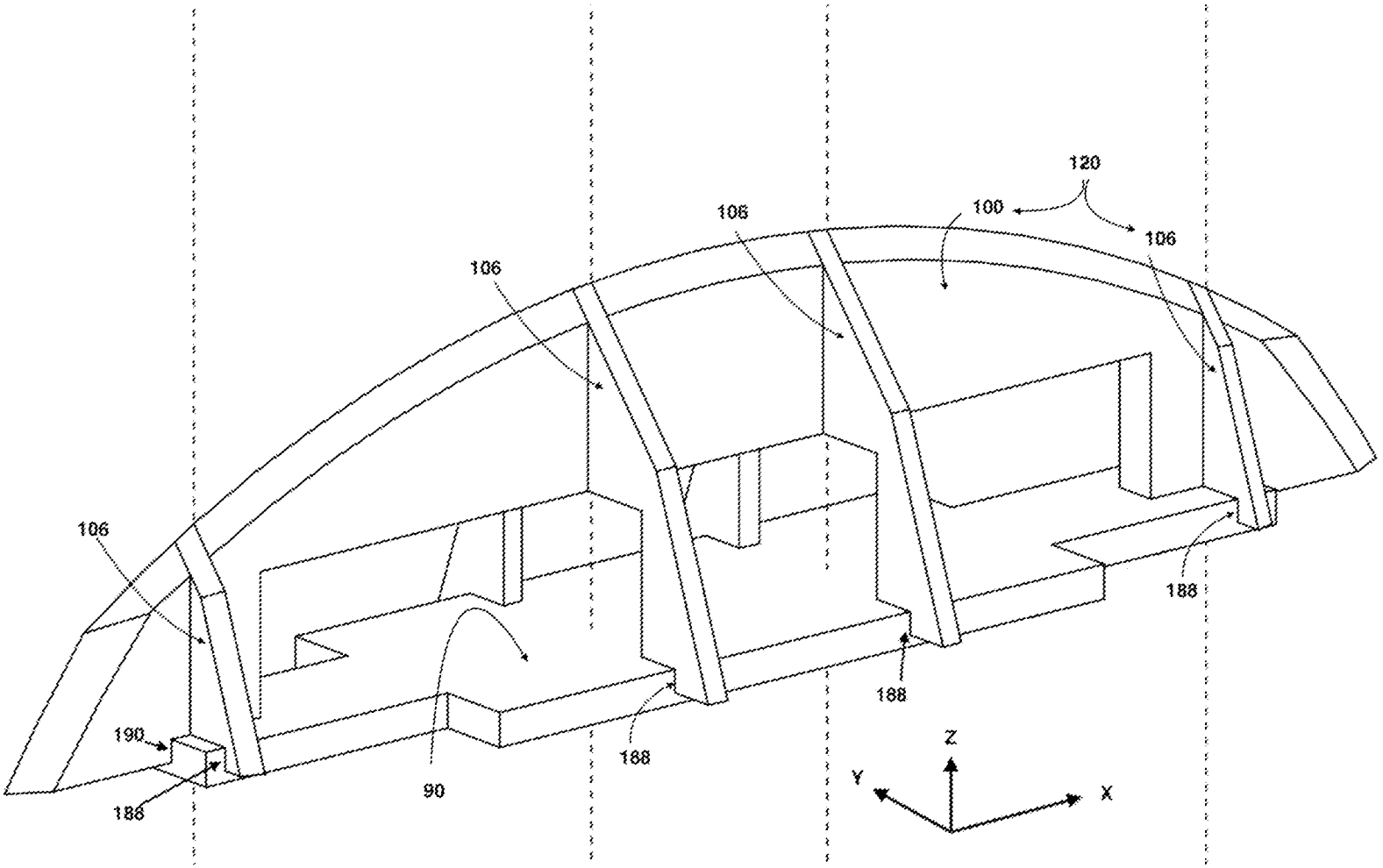
FIG. 9 illustrates the ribs, spine and plate jig of FIG. 8, wherein the ribs are inverted inserted into both the spine and the jig, thereby forming the hull skeleton, in accordance with one embodiment of the present disclosure.

In FIG. 8, the ribs 106*a-d* are inverted and aligned above the spine-jig assembly from FIG. 7. In FIGS. 8-9, the ribs 106*a-d* are inserted into the slots/joints 102 in the spine 100 and into the transverse slots 112 in the jig 90.

For instance, in FIG. 8 with reference to rib 106*b*, planar edge 180 of rib 106*b* sits flush in the coplanar bottom 182 of its corresponding transverse jig slot 112, preventing the rib 106*b* from rotating around the longitudinal axis, and the half-lap joint edges 184 of the rib 106*b* press against the faces of the spine 100 to eliminate any rotation of the spine 100 around the longitudinal X axis.

FIG. 8 also shows how the planar edge 170 of the spine 100 sits flush in the coplanar bottom 172 of its longitudinal jig slots 110, preventing the spine 100 from rotating around the transverse Y axis, and the half-lap joint edges 186 of the spine 100 press against the faces of the ribs 106 to eliminate any rotation of the ribs 106 around the transverse Y axis. The vertical walls 188 of the transverse jig slots 112 prevent the ribs 106*a-d* from rotating around the vertical Z axis or the transverse Y axis.

In FIG. 9, the vertical walls 190 of the longitudinal jig slots 110 prevent the spine 100 from rotating around the vertical Z axis or the longitudinal X axis. Since the bottoms of the slots 110, 112 are coplanar, and since the corresponding inserted edges 170, 180 of the skeleton elements are coplanar, the entire structure is vertically parallel when fully seated in the jig slots 110, 112. The skeletal structure 120 (i.e., spine 100 and ribs 106*a-d*) is now radially and axially true in all dimensions without further support or adjustment.

Once the skeleton elements 100, 106*a-d* are in the jig 90, various methods or techniques may be used to securely fix the transverse skeleton elements (i.e., ribs 106*a-d*) and longitudinal elements (i.e., spine 100) together; those methods may include fasteners and/or resins such as boat-grade epoxy and/or conventional glues. In one example, no fasteners or glues/epoxies are used at the connection points where the jig 90 is coupled with the spine 100, or where the jig 90 is coupled with the ribs 106*a-d*.

Figure 10C:
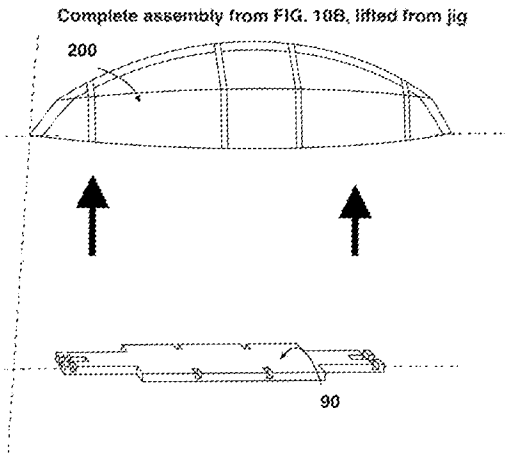
FIG. 10C illustrates paneled hull (including the skeleton) lifted out and removed from the jig, in accordance with one embodiment of the present disclosure.
Figure 10B:
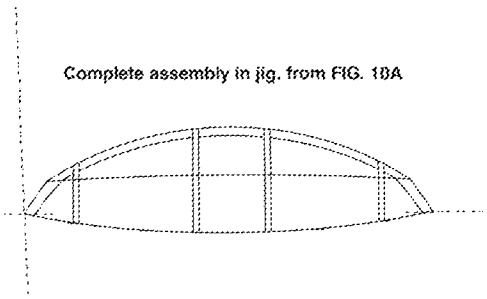
FIG. 10B illustrates hull skins panels installed on the skeleton in the jig of FIG. 10A, in accordance with one embodiment of the present disclosure.
Figure 10A:
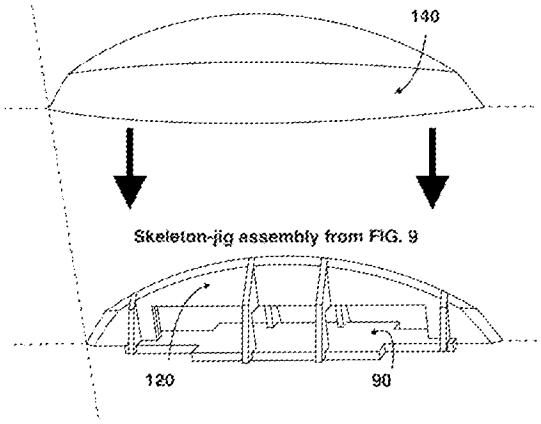
FIG. 10A illustrates hull skins panels and the skeleton and jig of FIG. 9, in accordance with one embodiment of the present disclosure.

Having formed the hull skeleton 120 as secured into position by jig 90, referring now to FIGS. 10A-10B which show how hull skin panels 140 can now be attached to the edges of the hull skeleton 120 to form the developable hull curvature as desired for the particular boat. Various methods may be used to securely fix the hull skin panels 140 to the skeleton 120 while it is in the jig 90; those methods may include fasteners and/or resins and/or conventional glues.

Once the hull skin panels 140 are permanently attached to the skeleton 120, the complete hull assembly 200 (i.e., the interconnected spine, ribs and hull skin panels) can be lifted vertically out of the jig 90 as shown in FIG. 10C. Since in one example, no glues/epoxies/fasteners are used at the connection points where the jig 90 is coupled with the spine 100 or where the jig 90 is coupled with the ribs 106*a-d*, de-coupling the finished hull 200 from the jig 90 is simplified. The ease of removal of the finished hull 200 from the jig 90 according to an embodiment of the present disclosure is particularly advantageous when compared with conventional jigs that typically require fasteners between the jig and the hull during construction of the hull.

Figure 11:
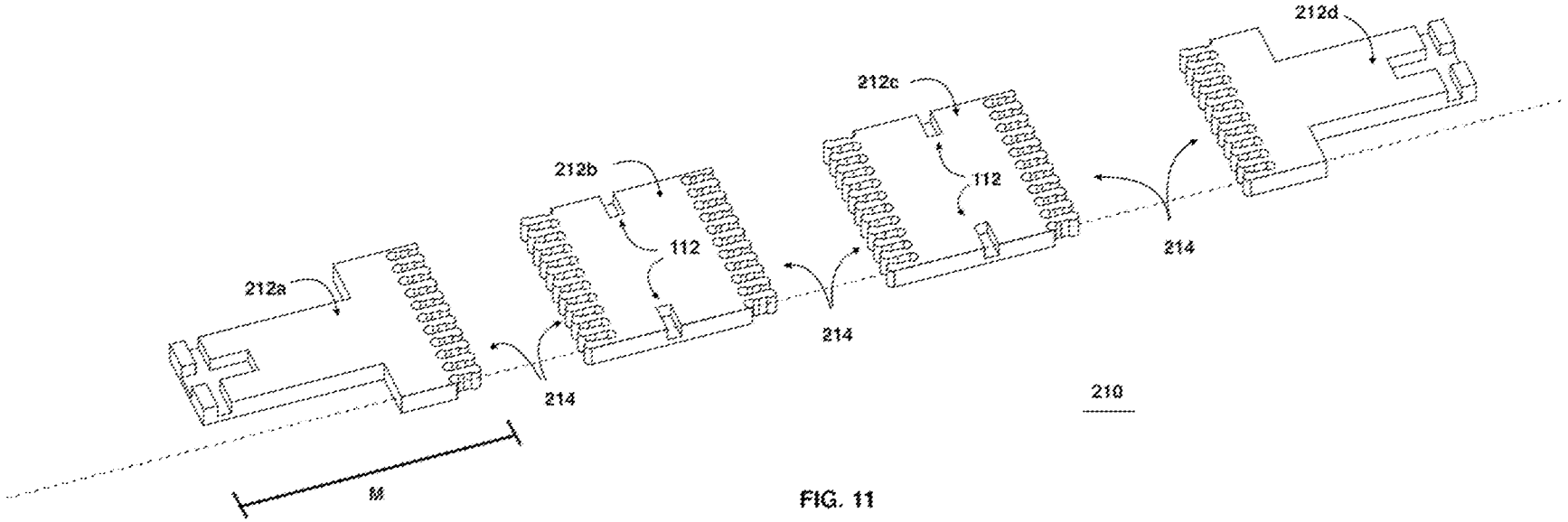
FIG. 11 illustrates another embodiment of a jig, wherein the jig is a multi-section plate jig, in accordance with one embodiment of the present disclosure.
Figure 12:
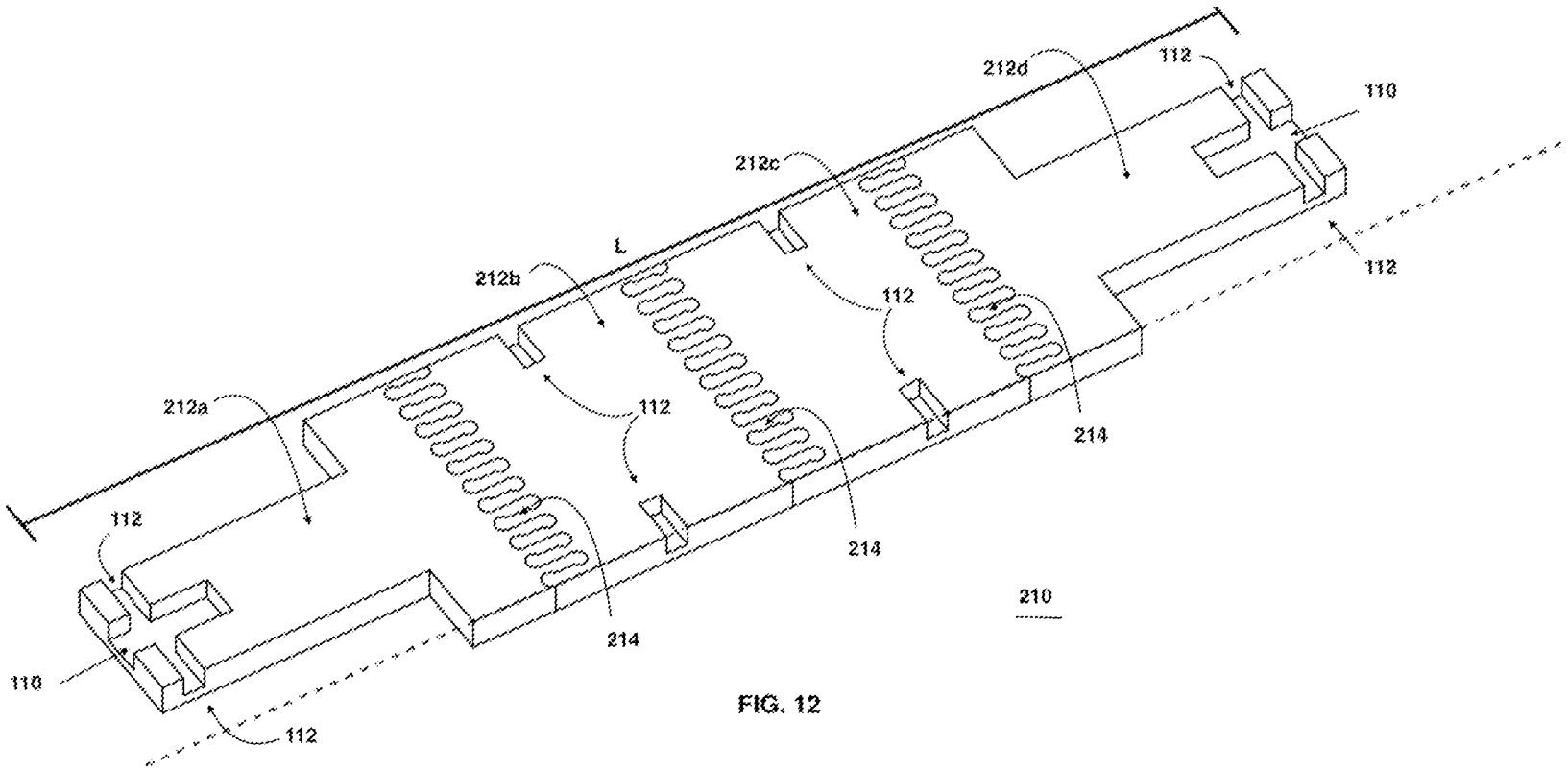
FIG. 12 illustrates the multi-section plate jig portions of FIG. 11, assembled to form a jig, in accordance with one embodiment of the present disclosure.

The plate jig 90 described herein can be a single unitary piece of wood/MDF or other material, or may be implemented using multi-piece versions of the previously described plate jig 90. FIGS. 11-12 illustrate an embodiment of a jig 210, wherein the jig 210 is a multi-section plate jig, in accordance with another embodiment of the present disclosure.

In some embodiments, a desired boat may be large enough that the length (shown as size L in FIG. 12) of the plate jig exceeds the maximum available size M (FIG. 11) of plates from which to fabricate the jig. FIG. 12 shows a jig 210 fabricated from several pieces 212*a-d*, with the pieces connected via self-aligning joints 214. The exact number of pieces 212 in this illustration and the specific design of joints 214 used in this illustration are for example only and are not intended to limit the scope of the present disclosure. Transverse slots 112 and longitudinal slots 110 can be formed in the jig 210 as shown in FIG. 12.

Figure 13:
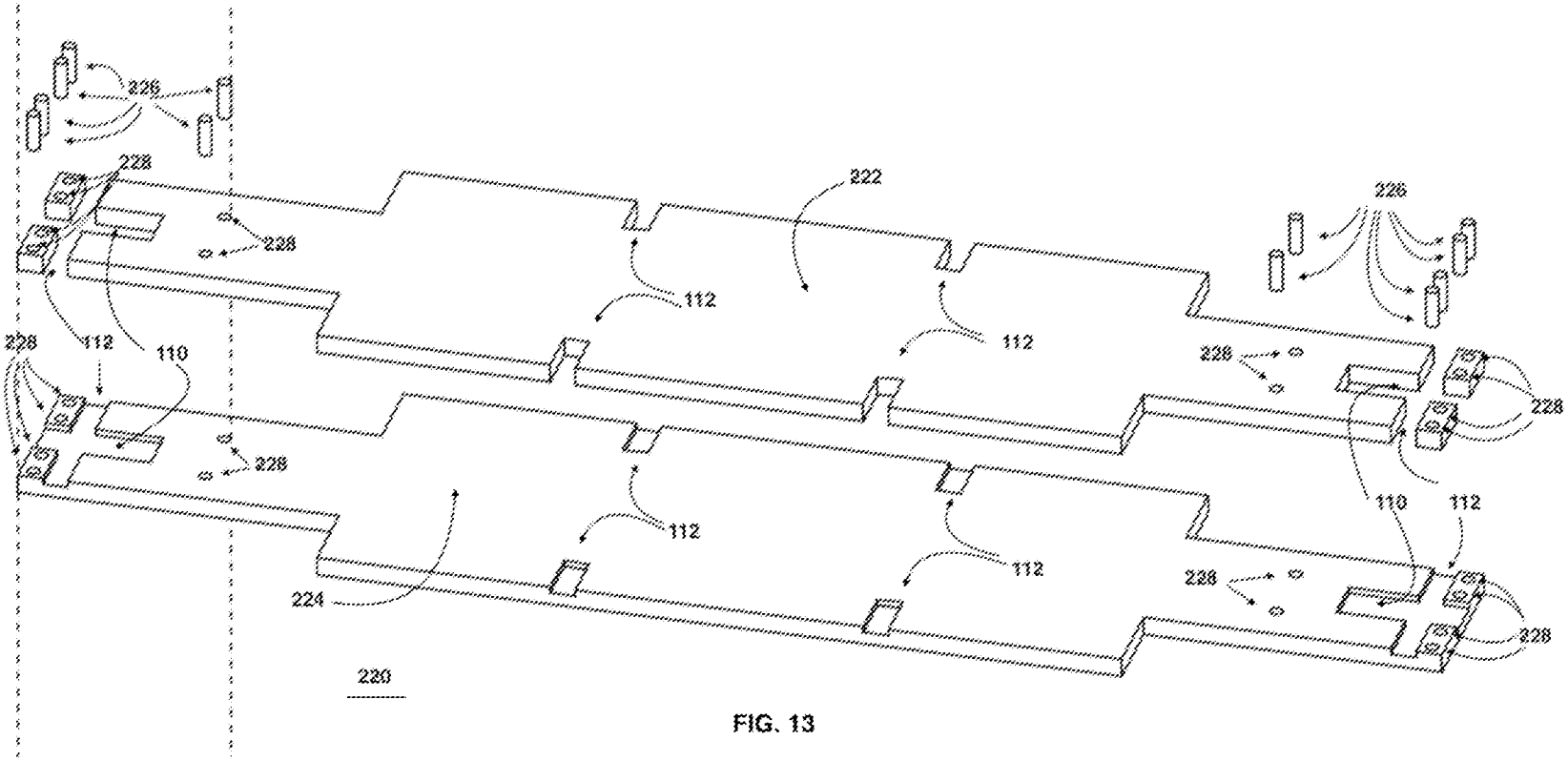
FIG. 13 illustrates another embodiment of a jig, wherein the jig is a multi-layer plate jig, in accordance with one embodiment of the present disclosure.
Figure 14:
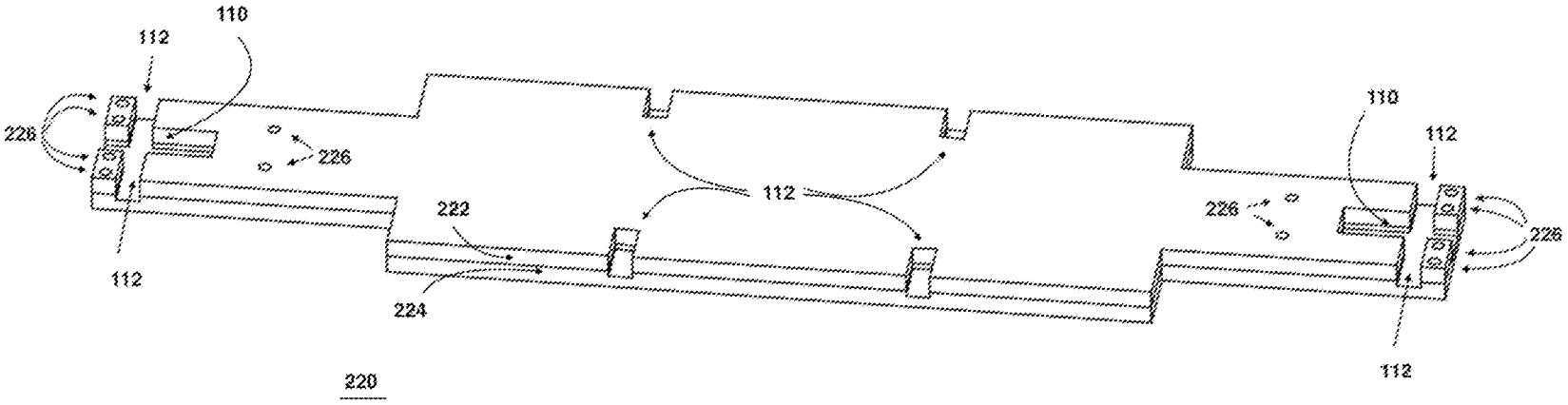
FIG. 14 illustrates the multi-layer plate jig of FIG. 13, assembled to form a jig, in accordance with one embodiment of the present disclosure.

The skeleton shape and materials for a particular boat may utilize a slot depth in the jig that is greater than the thickness of available plate material from which to fabricate the jig. FIGS. 13-14 show an example of a jig 220 created from multiple layers of plate material, in accordance with another embodiment of the present disclosure. In this example, a first or top layer 222 of material for the jig 220 is provided, and the transverse slots 112 and longitudinal slots 110 are cut or milled through the entire depth of this top layer 222. A second or lower layer 224 of material for the jig 220 is also provided, and the transverse slots 112 and longitudinal slots 110 are cut or milled to a depth that is through a portion of thickness of this lower layer 224. The layers 222, 224 are aligned and secured to each other using dowels or pins 226 through alignment holes 228, and adhesives/glue may also be used if desired.

In this manner, the total depth of the slots 110, 112 in the jig 220 is greater than the thickness of a single layer 222 of the jig material. The exact number of layers/pieces in this jig 220 and the alignment design between layers 222, 224 used in this illustration are provided for example only, and do not limit the scope of the present disclosure.

Figure 15:
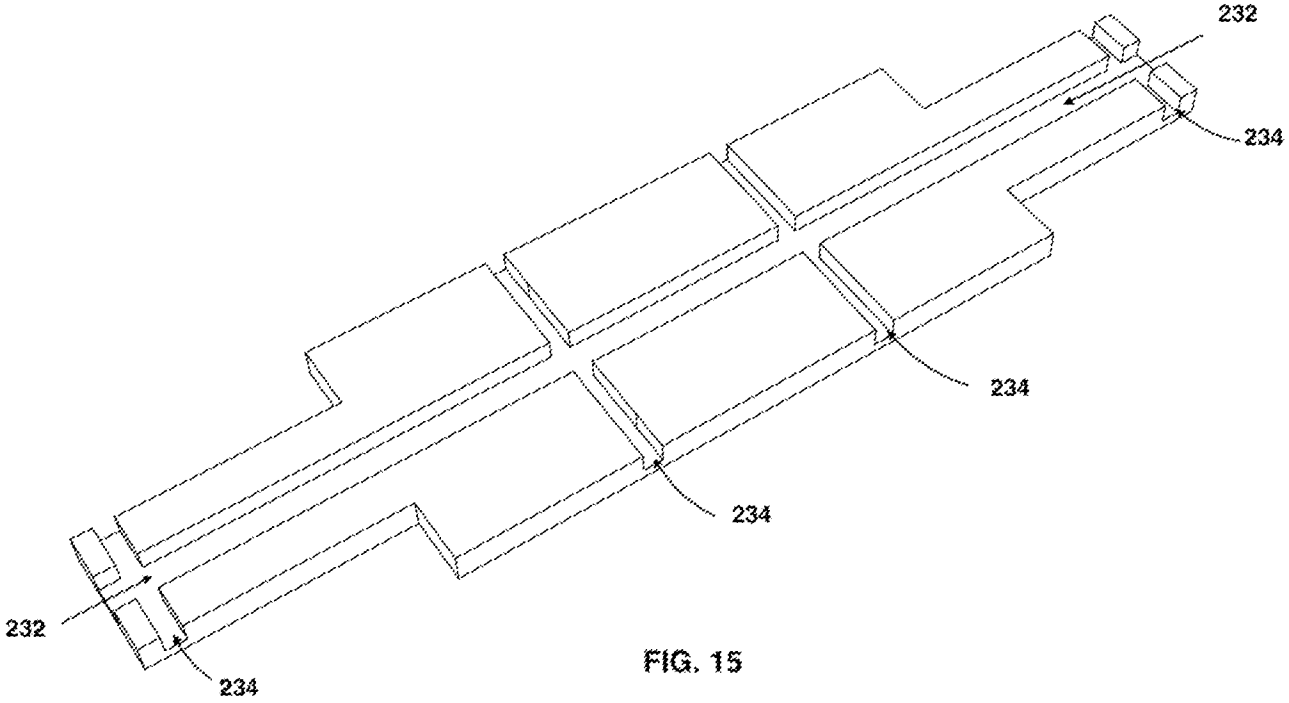
FIG. 15 illustrates another embodiment of a jig, wherein the jig has extended slots, in accordance with one embodiment of the present disclosure.

Referring now to FIG. 15, in another embodiment a jig 230 can be formed using extended longitudinal slots 232 and/or extended transverse slots 234, where one or more of the slots 232, 234 can extend the entire length or width of the jig 230.

In another embodiment, a jig can be formed using a combination of multiple horizontal sections as shown in FIGS. 11-12 with vertically-layered materials as shown in FIGS. 13-14 and extended slots in FIG. 15, or any combination thereof.

While embodiments of the present disclosure have been described with reference a hull skeleton formed using one spine 100 and four ribs 106*a-d*, it is understood that embodiments of the present disclosure could be implemented using more or fewer ribs 106, and/or using additional spines 100.

For instance, in one example, a boat could be implemented using several jig-skeleton-skin subgroups, with the resulting assembly from each jig-skeleton-skin group being subsequently fixed to each other to form the complete hull. The number of subgroups in such compound implementations, the way in which those subgroups divide the whole hull design, and the method by which the resulting subgroup assemblies are fixed into a whole hull may vary depending upon the particular implementation.

In another embodiment, a boat hull may be formed without use of longitudinal skeleton members such as spine 100. In such cases, a jig may be formed by increasing the depth of transverse slots/notches in the jig such that the transverse ribs will stand in proper alignment without need for a longitudinal spine member.

In one example, the ribs, spine and jig are manufactured using CNC (computer numerical control) routing of plate materials, in order to provide highly-precise and accurate formation of these hull components. Other parts of the boat, such as the deck, can also be formed using CNC routing.

Figure 17:
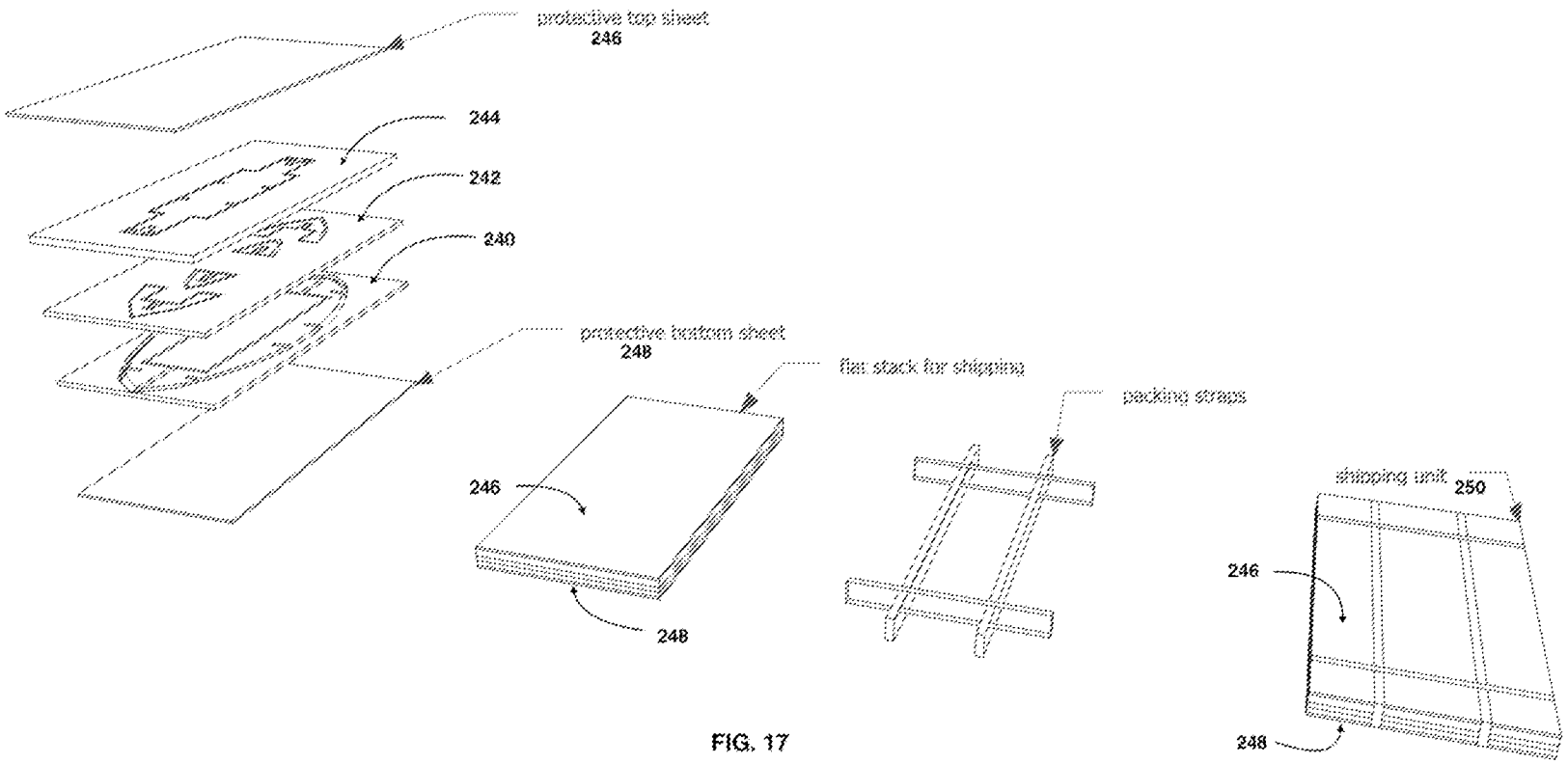
FIG. 17 illustrates an example of how the spine, ribs and jig of FIG. 16 can be combined to form a flat-packed shipping unit to be shipped to a customer, in accordance with one embodiment of the present disclosure.

FIG. 16 illustrates examples of forming CNC output sheets 240, 242, 244 having a spine 100, ribs 106, and a jig 90 using CNC milling from a planar wood material, in accordance with one embodiment of the present disclosure. FIG. 17 illustrates an example of how the CNC output sheets 240, 242, 244 with the spine 100, ribs 106 and jig 90 of FIG. 11 can be combined with protective top and bottom sheets 246, 248 to form a flat-packed shipping unit 250 to be shipped to a customer, in accordance with one embodiment of the present disclosure.

A CNC router has a router with a cutting bit, mounted on a motor-drive gantry, wherein the horizontal and vertical movements of the router are defined numerically via computer software and wherein those movements are executed by coordinated movement instructions sent to the drive motors controlling the location of the router cutting bit in X, Y, and Z dimensions relative to the stock material to be machined. The depth, length and shape of the cuts made by the CNC router is controlled by the computer software.

In a simple example, to cut a circular/round tabletop structure from a planar wood stock material, a Computer Aided Design (CAD) software package would be loaded with the diameter of the circle for the top, and the location of the center of the circle within the XY extent of the material stock. The CAD package would calculate a series of points (X,Y) along the perimeter of the circle, would define a series of movements from one point to the adjacent point all the way around the series of points along the circle, and would then create a Numerical Control (NC) file encapsulating these XY movements along with cutting height (Z) control instructions related to the thickness of the material stock. The CNC operator would place stock material of the specified size and thickness on the CNC router table and load the NC program file into the CNC router control computer. Upon the operator's command, the CNC router control computer would initiate the router spindle and move the router in X, Y, and Z to the location just above the first perimeter point in the instruction set. It would then move the router vertically (Z) to the bottom of the stock material at that point, after which it would move the router in X and Y to the coordinate of the next point along the perimeter of the circle to be cut, then the next, etc., until finally returning to the first perimeter point. The CNC router control would then withdraw the bit from the stock material and disengage the router motor. At this point, the round tabletop has been cut from the stock material.

CNC routers can also be used to intrude slots into stock material instead of cutting completely through the stock material. In such cases, the Z depth of cutting is less than the Z depth of the stock material. Furthermore, CNC routers can be used to carve complex 3D curved objects from stock material. In such cases, the Z depth is dynamically defined in sync with the dynamic definitions of X and Y for each point on the cutting path; this makes it possible to, for instance, carve a topo map of a mountain range from a thick piece of wood.

In order to use a CNC router to cut the jig, spine and ribs (such as 90, 100, 106) according to one embodiment of the present disclosure, CAD software is used to define the 3-dimensional shape of each rib and spine part for the boat skeleton, which includes thickness, extent, and any edge beveling required. The designer then digitally assembles the skeleton from these parts. A copy of the assembled skeleton is then inverted and intruded digitally into a plate representing the stock material for the jig, leaving slot impressions in the digital jig stock precisely matching the pattern of the tops of the skeleton elements. The depth of the intrusion will depend upon the desired size of the boat, the shape of the parts, and the construction material being specified by the designer; however, a depth appropriate for many designs according to embodiments of the present disclosure may be is 25 mm or other amount. The designer then expands the horizontal wall offsets of the jig slot impressions by a small amount to allow a tolerance such that the physical skeleton elements will be able to be inserted into the slots in the physical jig. That is, the slots must be slightly wider than the skeleton parts they will receive. A 0.5 mm offset for each wall has been found to be sufficient to permit the skeleton parts to be inserted fully and still provide firm vertical support; although it is understood that jigs, spines and ribs could be formed according to some embodiments of the present disclosure using other offset/tolerance values.

When the designs of the spine, ribs and the jig (and any other desired boat part) are complete in the CAD package, the designer exports the CNC program files and the setup instructions for the CNC router operator. The operator then runs each CNC program as specified, against stock material as specified. The CNC router then operates to mill/cut/form the physical parts corresponding to the digital parts designed in the CAD program: specifically, the ribs, spine, as well as the jig which will receive those skeleton parts and support them in proper orientation per the design.

In one example, if the thickness of the transverse rib elements 106 of the skeleton of a particular boat design were 12 mm, the jig slot 112 could be machined to 13 mm width and 25 mm depth, such that the rib elements 106 could be inserted into the corresponding jig slot 112 snugly and deeply enough to hold the skeleton element in proper orientation. In one example, the thickness of the spine 100 may be 24 mm, and the slot dimensions for the longitudinal slots 110 may be 25 mm in width and 25 mm in depth to receive the spine top portions.

A method to form a boat hull may include the following process steps or operations. In one example, a jig (such as jig 90) is provided according to one example of the present disclosure. The jig may formed using CNC milling of a flat or planar piece of wood material, wherein a CNC router is programmed with the desired design of the jig. The jig may be positioned on a flat work surface, such as a platform. A spine member (such as spine 100) is provided, and inverted, then coupled with the jig. In one example, portions of the top surface of the spine member are inserted into slots of the jig which retain the spine member in a fixed position and orientation relative to the jig. One or more rib members (such as ribs 106*a-d*) are then coupled with the spine member and with the jig. In one example, the rib member includes slots that mate with slots in an outer curved or arced bottom edge of the spine member. The jig also includes slots to receive a portion of the top surfaces of the rib members, so that the rib members are secured both to the jig and to the spine. Adhesives, epoxies and/or fasteners can then be used to permanently secure the rib members to the spine member, to thereby form a unified hull skeleton. One or more hull panels (such as hull panels 140) may then be permanently attached to the outside of the hull skeleton (using conventional adhesives, epoxies and/or fasteners as desired). Once the hull is permanently formed, the hull is lifted out of the jig. The remainder of the boat can then be built upon hull. The method may also include any other process step disclosed herein, or may include providing for any structural feature disclosed herein.

The various jigs described herein in accordance with embodiments of the present disclosure provide highly precise alignment of the plurality of rib pieces to the spine. This enables the building of a non-deformed boat hull by an amateur boat builder without the need for a complex conventional jig.

Further, in one example, embodiments of the present invention provide that a boat may be made in a significantly shorter time frame than some boats built via conventional methods. For instance, an example of a boat has been made in approximately 300 hours, which is a more efficient build time when compared with some conventional amateur boat kits. Moreover, the resulting boat made is of high precision, with improved durability and sails straighter when compared with other boats that can be made by amateurs.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It should be appreciated that reference throughout this specification to "one embodiment" or "an embodiment" or "one example" or "an example" means that a particular feature, structure or characteristic described in connection with the embodiment may be included, if desired, in at least one embodiment of the present disclosure. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the disclosure.

It should be appreciated that in the foregoing description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, inventive aspects lie in less than all features of a single foregoing disclosed embodiment, and each embodiment described herein may contain more than one inventive feature.

While the present disclosure has been particularly shown and described with reference to various embodiments thereof, it will be understood by those skilled in the art that various other changes in the form and details may be made without departing from the spirit and scope of the present disclosure.

The invention claimed is:

1. A system for aligning a boat skeleton, comprising:

at least one longitudinal spine member of the boat skeleton with at least one slot in a bottom edge, wherein the spine member is formed by CNC milling of one or more wood-based plates, and wherein the spine member is flat-packable for shipping prior to assembly into the boat skeleton;

at least one transverse rib member of the boat skeleton, the at least one rib member having a slot adapted to be inserted into the at least one slot of the spine member, wherein the at least one rib member is formed by CNC milling of one or more wood-based plates, and wherein the at least one rib member is flat-packable for shipping prior to assembly into the boat skeleton; and a plate jig including at least a first pair of opposing slots to receive a portion of a top surface of the spine member, the jig also including at least a second pair of opposing slots to receive a portion of a top surface of the at least one rib member; wherein the plate jig is formed by CNC milling of one or more wood-based plates, and wherein the plate jig is flat-packable for shipping prior to use;

wherein the spine member and the at least one rib member are adapted to be interlocked orthogonally to one another;

wherein the spine member and the at least one rib member are adapted to be inserted into the plate jig without being attached to the plate jig thru one or more additional fasteners;

wherein the spine member and the at least one rib member are adapted to be permanent structural members of the boat skeleton without cutting away any material from the spine member or the at least one rib member;

wherein when the spine member and the at least one rib member are interlocked to one another and inserted into the plate jig, the spine member, the at least one rib member and the plate jig form a free-standing self-supporting framework that is properly aligned in 3 axes to allow attachment of a plurality of wood-based plate hull panels in developable arcs to form a hull assembly; and wherein the hull assembly including the spine member and the at least one rib member are adapted to be lifted vertically out of the plate jig without removing any fasteners or cutting away any other material.

2. The system of claim 1, wherein a depth of the first pair of opposing slots is equal to a depth of the second pair of opposing slots.

3. The system of claim 1, wherein the jig includes a first end portion, a second end portion, and a central portion between the first and second end portions.

4. The system of claim 3, wherein the first pair of opposing slots to receive a portion of the top surfaces of the spine member are positioned on a set of outer edges of the first end portion and the second end portion.

5. The system of claim 3, wherein the second pair of opposing slots to receive a portion of the top surfaces of the at least one rib member is positioned on a set of outer edges of the central portion of the jig.

6. The system of claim 1, wherein the jig is a solid piece of wood material.

7. The system of claim 1, wherein the jig is formed of a plurality of adjacently connected pieces of wood material, each piece having the same maximum thickness, wherein each piece of wood material has a connection interface for securely coupling with at least one other piece of wood material of the jig.

8. The system of claim 1, wherein the jig is formed of a plurality of stacked layers of wood material.

9. The system of claim 8, wherein the plurality of stacked layers of wood material includes a top layer and a bottom layer, wherein the first pair of slots are cut through the entire thickness of the top layer.

10. The system of claim 9, wherein the first pair of slots are cut into the bottom layer wherein said first pair of slots have a depth less than the thickness of the bottom layer.

11. The system of claim 1, wherein the first pair of opposing slots extends a length of the jig along a top surface of the jig.

12. The system of claim 1, wherein the second pair of opposing slots extends across a width of the jig along a top surface of the jig.

13. The system of claim 1, wherein the jig has a perimeter that is smaller than an inner diameter of a hull skin.

14. The system of claim 1, wherein the jig is connected with the at least one rib member without the use of external fasteners.

15. The system of claim 1, wherein the jig is connected with the at least one spine member without the use of external fasteners.

16. The system of claim 1, wherein the jig is made from MDF material.

17. A system for forming a boat hull skeleton, comprising:

at least one longitudinal spine member with at least one slot in a bottom edge, wherein the spine member is formed by CNC milling of one or more wood-based plates, and wherein the spine member is flat-packable for shipping prior to assembly into the boat skeleton;

at least one transverse rib member, the at least one rib member having a slot adapted to be inserted into the at least one slot of the spine member, wherein the at least one rib member is formed by CNC milling of one or more wood-based plates, and wherein the at least one rib member is flat-packable for shipping prior to assembly into the boat skeleton; and a horizontal planar jig including at least a first pair of opposing slots to receive a portion of a top surface of the spine member, the jig also including at least a second pair of opposing slots to receive a portion of a top surface of the rib member, wherein the jig is formed by CNC milling of one or more wood-based plates, and wherein the jig is flat-packable for shipping prior to use;

wherein the at least one longitudinal spine member and the at least one transverse rib member are orthogonally connected together;

wherein the spine member and the at least one rib member are adapted to be inserted into the jig without being attached to the jig thru one or more additional fasteners;

wherein the spine member and the at least rib member are adapted to be permanent structural members of the boat hull skeleton without cutting away any material from the spine member or from the at least one rib member;

wherein when the spine member and the at least one rib member are interlocked to one another and inserted into the jig, the spine member, the at least one rib member and the jig form a free-standing self-supporting framework that is properly aligned in 3 axes to allow attachment of a plurality of wood-based plate hull panels in developable arcs to form a hull assembly; and wherein the hull assembly including the spine member and the at least one rib member are adapted to be lifted vertically out of the jig without removing any fasteners or cutting away any other material.

18. The system of claim 17, wherein a depth of the first pair of opposing slots is equal to a depth of the second pair of opposing slots.

* * * * *